US009215945B2

(12) United States Patent
PeCoy

(10) Patent No.: US 9,215,945 B2
(45) Date of Patent: Dec. 22, 2015

(54) COVER FOR DECORATED CHRISTMAS TREE

(71) Applicant: Lori A. PeCoy, Fort Dodge, IA (US)

(72) Inventor: Lori A. PeCoy, Fort Dodge, IA (US)

( * ) Notice: Subject to any disclaimer, the term of this patent is extended or adjusted under 35 U.S.C. 154(b) by 198 days.

(21) Appl. No.: 13/676,665

(22) Filed: Nov. 14, 2012

(65) Prior Publication Data

US 2014/0130947 A1 May 15, 2014

(51) Int. Cl.
*A47G 33/04* (2006.01)

(52) U.S. Cl.
CPC ..... *A47G 33/04* (2013.01)

(58) Field of Classification Search
CPC ..... A47G 33/04
USPC ..... 206/423; 47/20.1, 23.1, 23.2, 24.1, 47/29.1, 29.5, 30, 31, 31.1, 32.3
See application file for complete search history.

(56) References Cited

U.S. PATENT DOCUMENTS

| | | | | | |
|---|---|---|---|---|---|
| 237,026 | A | * | 1/1881 | Knauff | 428/7 |
| 1,747,892 | A | * | 2/1930 | Fisher | 248/317 |
| 2,781,811 | A | | 2/1957 | Dilar et al. | |
| 2,868,255 | A | | 1/1959 | Fancher | |
| 2,879,780 | A | * | 3/1959 | Arbore | 135/100 |
| 2,911,025 | A | * | 11/1959 | Paros | 206/423 |
| 3,040,477 | A | * | 6/1962 | June | 47/42 |
| 3,480,241 | A | * | 11/1969 | Moyer | 47/40.5 |
| 3,861,629 | A | * | 1/1975 | Merrill | 47/40.5 |
| 4,054,166 | A | | 10/1977 | Burke | |
| 4,384,604 | A | | 5/1983 | DeLaura et al. | |
| 4,581,277 | A | * | 4/1986 | Neale | 428/181 |
| 4,889,309 | A | * | 12/1989 | McCure | 248/524 |
| 4,969,555 | A | | 11/1990 | Fitzgerald | |
| 5,291,999 | A | * | 3/1994 | Phair | 206/423 |
| D349,469 | S | | 8/1994 | Mitchell | |
| 5,425,199 | A | * | 6/1995 | Sofy | 47/40.5 |
| 5,575,242 | A | | 11/1996 | Davis et al. | |
| 5,590,775 | A | | 1/1997 | Moore | |
| 5,687,505 | A | | 11/1997 | Haufler et al. | |
| 6,088,953 | A | | 7/2000 | Morgan | |
| 7,137,398 | B2 | * | 11/2006 | George | 135/90 |
| 2003/0009936 | A1 | * | 1/2003 | Hodson | 47/29.1 |
| 2004/0144022 | A1 | * | 7/2004 | Roebuck | 47/29.1 |
| 2007/0242595 | A1 | * | 10/2007 | DiCosola | 369/273 |
| 2010/0170818 | A1 | * | 7/2010 | Lin | 206/423 |
| 2012/0055083 | A1 | * | 3/2012 | Marquez et al. | 47/45 |

OTHER PUBLICATIONS

Google search for ribbon around christmas tree (before Nov. 13, 2012).* http://betterdecoratingbible.com/tag/garlands , p. 36 Lonny Mag picture, posted Dec. 21, 2011.*

* cited by examiner

*Primary Examiner* — Tri Mai

(74) *Attorney, Agent, or Firm* — McKee, Voorhees & Sease, PLC

(57) ABSTRACT

A removable cover is provided for a decorated Christmas tree to prevent house pets from getting into the tree or playing with ornaments and lights on the tree. The cover wraps at least partially around the tree, with the top edge being hooked to tree branches with the top of the tree extending above the cover. Preferably, the bottom edge of the cover drapes onto the floor. The cover may partially or fully enclose the tree from the floor up to a desired height. The tree cover can be quickly and easily placed on the tree when people are sleeping or out of the house, and easily removed and stored when display of the tree is desired. The cover is a sheer material so that ornaments and lights are visible through the material when the cover is on the tree.

4 Claims, 4 Drawing Sheets

COVER FOR DECORATED CHRISTMAS TREE

BACKGROUND OF THE INVENTION

This invention relates generally to a cover for protecting a decorated indoor Christmas tree from cats and dogs or other household pets, or small children.

It is well known that a decorated Christmas tree has an alluring quality among house pets, especially cats and dogs. The house pets may be drawn to the dangling or sparking ornaments or lights. The house pets may get too close to the tree and ornaments, such as crawling under the tree or climbing up the base of the tree to nest among its branches. This may cause ornaments to fall off and break or worse, cause the tree to topple or branches to break, which may harm the pet and destroy the tree.

Various prior art exists, which is directed specifically towards keeping house pets out of Christmas trees. One option is disclosed in U.S. Pat. No. 5,575,242 to David which uses a radio transmitter worn on the pet's collar that produces a high-pitched frequency when the pet approaches an antenna loop around the base of the Christmas tree, preventing the pet from interacting with the tree or its ornamentation. This system, however, is costly and requires substantial setup. In addition, it only works so long as the house pet is wearing a properly functioning transmitter.

Additional prior art directed towards keeping animals away from plants includes cylindrical screens enclosing the plants. U.S. Pat. No. 5,687,505 to Haufler discloses a free-standing plant pen that serves as a barrier to keep pets away from potted plants. U.S. Pat. No. 6,088,953 to Morgan discloses a mesh cover that suspends from an internal pole and curtains out unwanted animals. Both of these enclosures have slow setup and are not easily stowed.

Christmas tree disposal bags or covers are also known, which wrap around the tree with opposite edges connected together with snaps, zippers, or other fasteners, which are cumbersome and sometimes fail. Other prior art plastic disposal bags are pulled upwardly from the floor to surround the tree and are tied at the top. However, such bags often snag when being raised or lowered, which may tear the bags, break tree branches, or knock ornaments from the tree. These disposal bags are not intended to be used on decorated trees or remain on a standing tree in a house.

Accordingly, a primary objective of the present invention is the provision of a cover that covers at least the lower portion of a decorated Christmas tree to protect the tree, its ornaments and lights from house pets.

Another objective of the present invention is the provision of a cover for a decorated Christmas tree which hooks onto the tree branches.

Yet another objective of the present invention is the provision of a protective device for a decorated Christmas tree which fits different sizes of trees.

Still another objective of the present invention is the provision of a sheet of material which covers part or all of a decorated Christmas tree to protect the tree and ornaments from pets and children.

Another objective of the present invention is the provision of an inexpensive Christmas tree cover that can be quickly and easily placed onto and removed from the decorated Christmas tree.

A further objective of the present invention is the provision of a decorated Christmas tree cover that can be easily and compactly stored when not in use.

Still another objective of the present invention is the provision of a decorated Christmas tree cover that is economical to manufacture and effective in use.

These and other objectives will become apparent from the following description of the invention.

BRIEF SUMMARY OF THE INVENTION

This invention is directed towards a protective cover that quickly and easily encloses at least a portion of a decorated Christmas tree to prevent house pets from getting into the tree or playing with the ornaments and/or lights. The cover extends partially or fully around the tree and can be secured to the tree using hooks which hook to the tree branches at any desired location. The cover may also enclose gifts underneath the Christmas tree. The cover can be quickly and easily placed on the tree whenever it is desirable to keep house pets out of a decorated Christmas tree, such as during the day when the owner is at work or at night when people are sleeping. Further, the cover can be easily removed and stored when it is desirable to display the decorated tree. The cover is made from shear or clear material such that the ornaments and lights on the tree can be seen through the material while the cover is on the decorated tree.

DETAILED DESCRIPTION OF THE DRAWINGS

Figure 1:
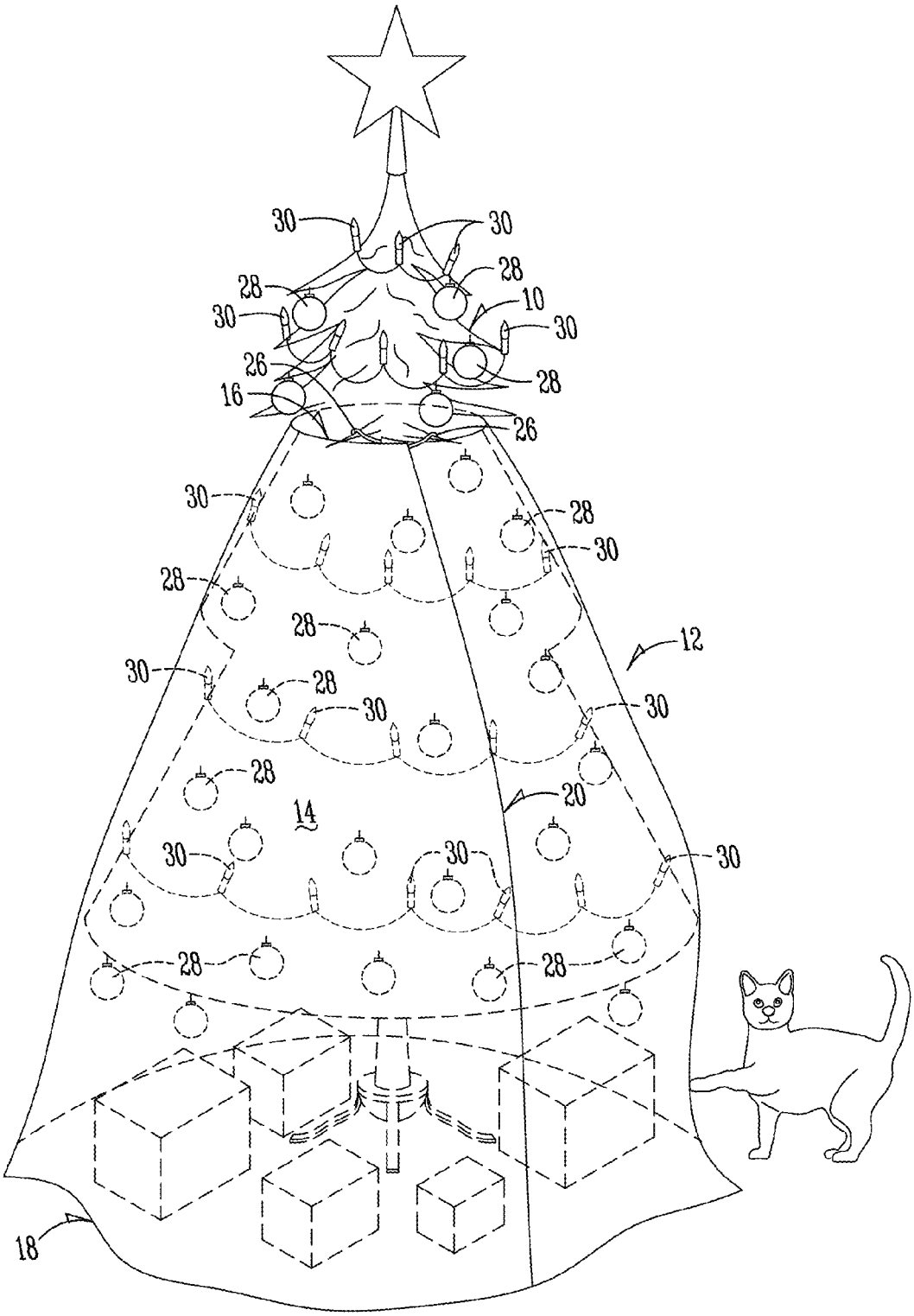
FIG. 1 is a perspective view showing one embodiment of the Christmas tree cover secured around a Christmas tree.
Figure 2:
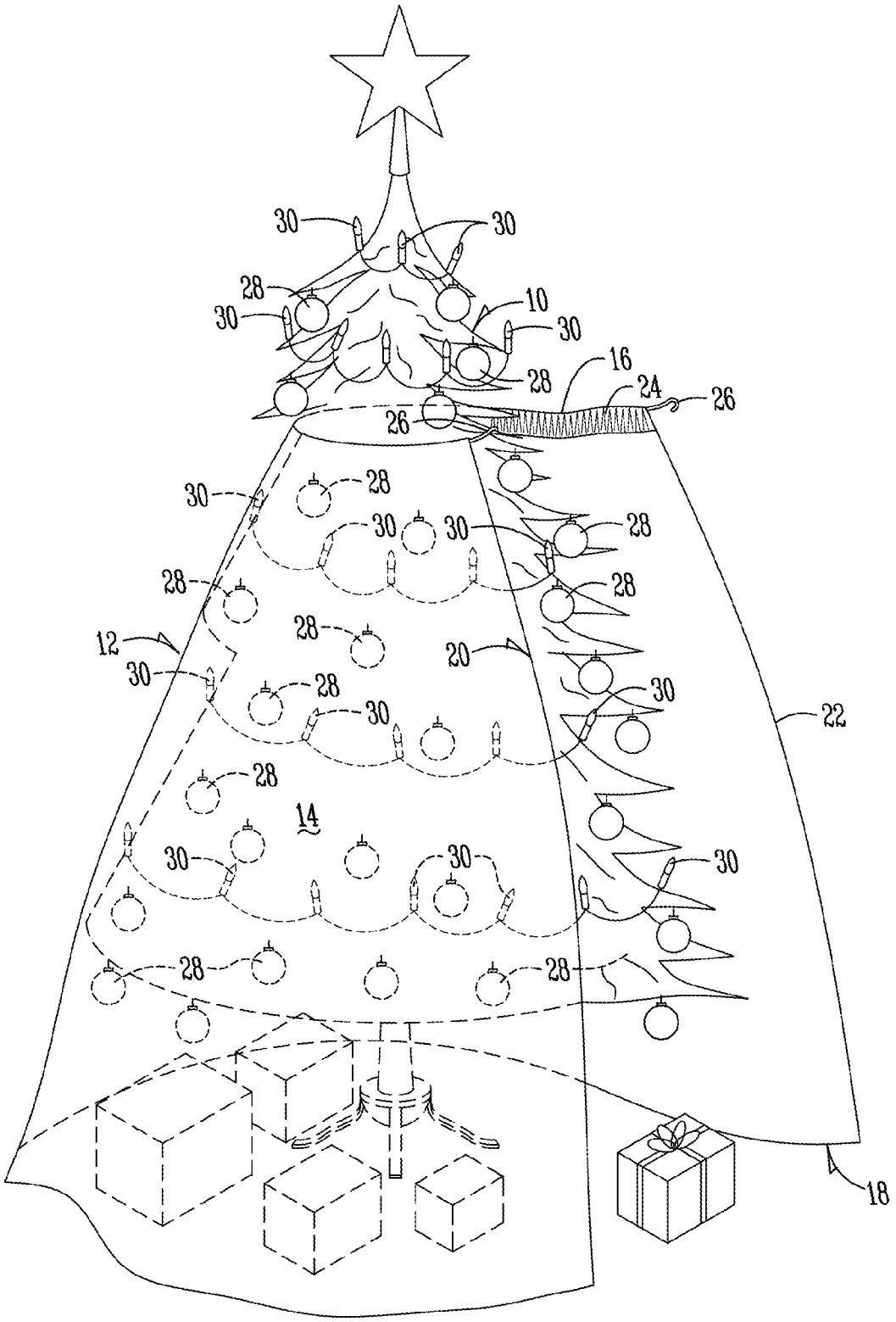
FIG. 2 is a perspective view of the cover partially placed on or removed from a decorated Christmas tree.

FIGS. 1 and 2 show a decorated Christmas tree 10 having a preferred embodiment of a cover 12 of the present invention wrapped around the tree 10. This embodiment of the cover 12 extends approximately one-half to fully around a tree, depending on the size of the tree 10 and the dimension of the material used to make the cover 12. This cover 12 may be used on trees which are placed in a corner, next to a wall, or in front of a window wherein the wall or window precludes access to the tree by a pet. Therefore, only a portion of the tree may need to be protected from the pet.

Figure 3:
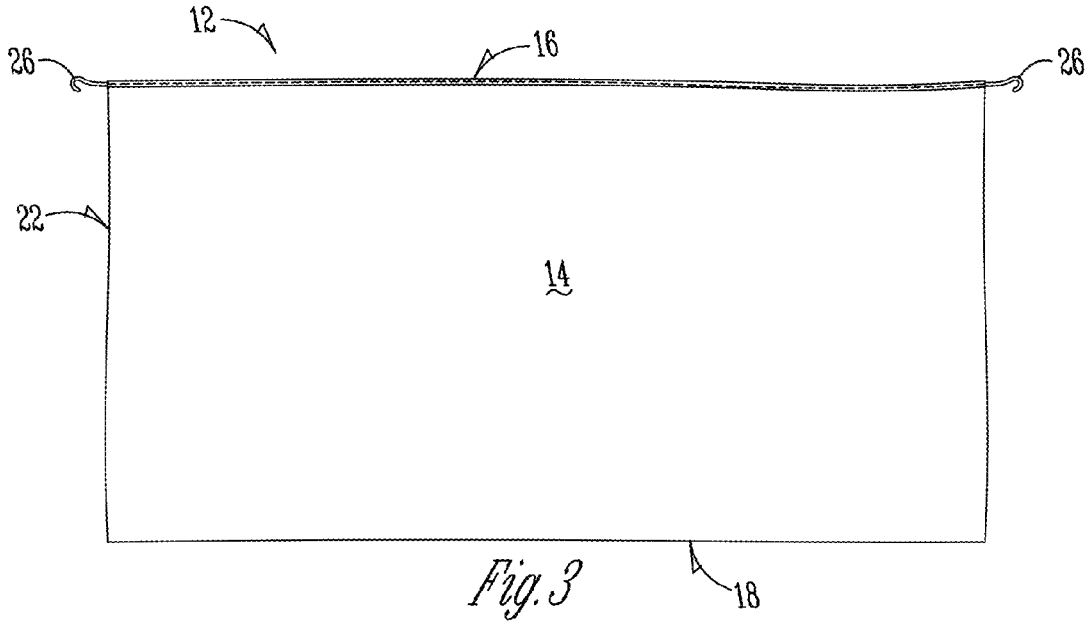
FIG. 3 is a plan view showing a piece of the shear or clear material for an unfinished cover of the present invention.
Figure 4:
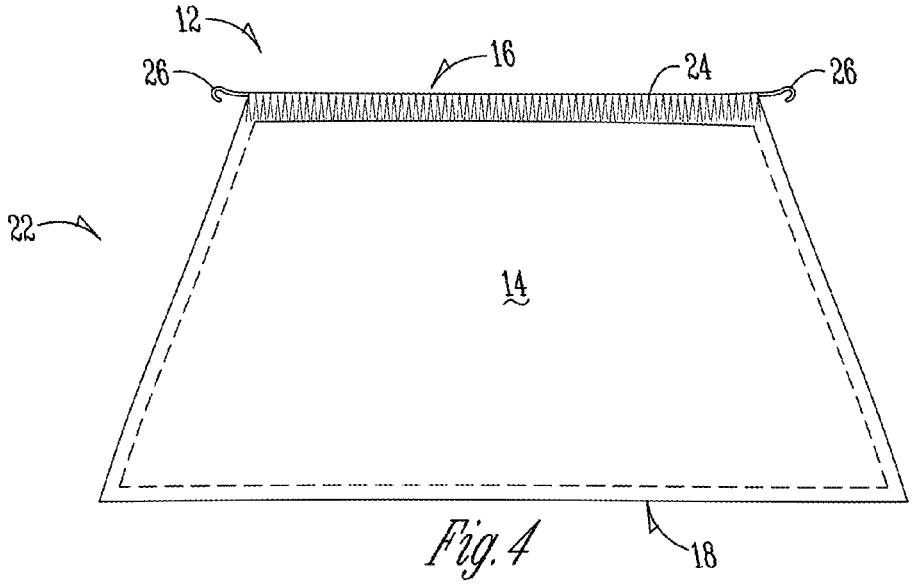
FIG. 4 is a plan view showing the sheet of material from FIG. 3 in a finished form, including stitched side and bottom edges, an elastic top edge, and hooks.

In the embodiment of FIGS. 1-4, a sheet of shear or clear material 14 is cut so as to define a top edge 16, a bottom edge 18, and opposite side edges 20, 22. The bottom 18 and side edges 20, 22 may be turned inwardly and sewn for a finished look, as shown in FIG. 4. The top edge 16 may be provided with elastic 24 and has hooks 26 at the upper corners, as best seen in FIGS. 2 and 3. Additional hooks may be provided along the top edge 16, if desired. Hooks 26 on the upper corners of the cover 12 are adapted to hook over the branches of a tree 10 for quick and easy installation of the cover 12 around the front exposed portion of the tree 10 or fully around the tree 10. The elastic 24 facilitates positioning of the cover 12 on the tree 10. With the shear or clear material, the ornaments 28 and lights 30 on the tree 10 can be seen through the material, as shown in FIG. 1. Thus, the cover 12 can be kept on the tree 10 full time, or can be easily removed by unhooking the hooks 26, for example when owners are home to watch over the pets. When the owners are gone or asleep, the cover 12 can be quickly and easily installed on the decorated tree 10 to preclude pets from climbing in the tree 10 and from touching or attacking the ornaments 28 and lights 30.

Figure 5:
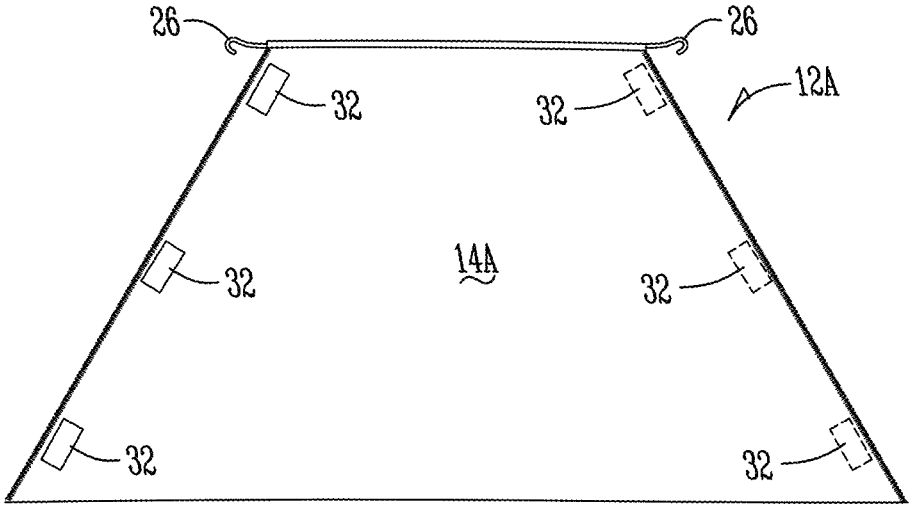
FIGS. 5 and 6 are plan views showing alternative shapes for the cover according to the present invention.
Figure 6:
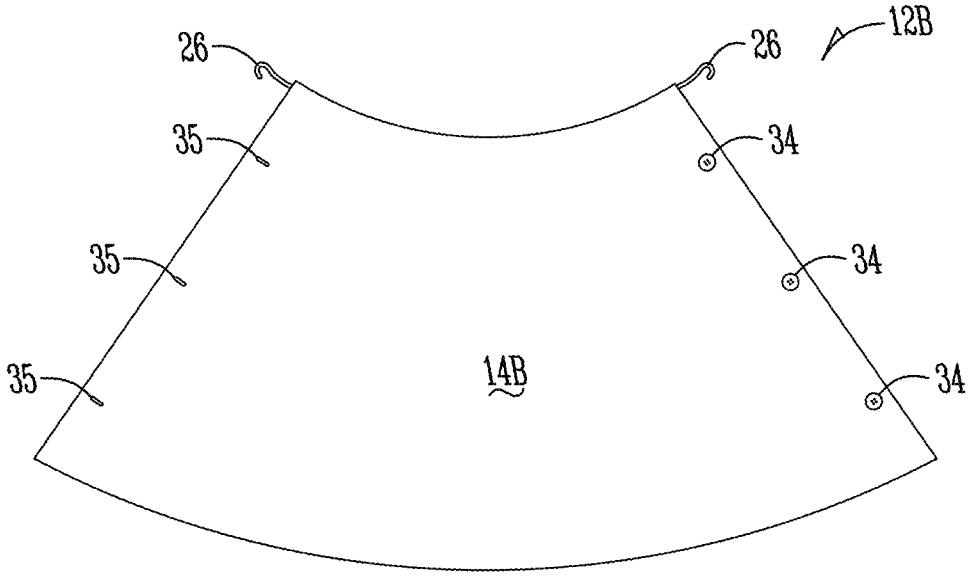

In alternative embodiments of the cover 12A and 12B, the cut of the material 14A, 14B may be modified, as shown in FIGS. 5 and 6. Also, the opposite side edges 20, 22 of the sheet of material may optionally include fasteners, such as hook and loop fasteners 32, snaps, buttons 34 and button holes 35, magnets, or zippers, so that the edges can be secured to each other when the cover 12 wraps fully around the tree 10, if desired.

Thus, it can be seen that the Christmas tree cover 12 according to the present invention can be quickly and easily installed and removed from the decorated tree 10, as desired, so as to protect the ornaments 28 and lights 30 from pets. The top of the tree 10 will normally extend above the cover 12 when the cover 12 is in place on the tree 10.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A method of protecting ornaments on a Christmas tree, comprising:

providing a sheet of material having opposite upper and lower edges and opposite lateral side edges and having hooks on the upper corners;

setting the Christmas tree upright in a tree stand on a support surface; then decorating the upright Christmas tree with ornaments hanging from branches of the tree; then hooking a first upper corner of the sheet of material to a branch of the upright Christmas tree; then wrapping the material around the decorated Christmas tree while the tree is upright so as to overlap the lateral side edges; then hooking a second upper corner of the sheet of material to a branch of the upright tree;

whereby the material hangs downwardly from the hooked branches, with the lower edge of the material draping adjacent the support surface, so as to cover all the ornaments on the upright tree below the upper edge of the sheet of material and between the opposite lateral side edges.

2. The method of claim 1 wherein the material is wrapped around the tree without pulling the material upwardly around the tree from the support surface.

3. The method of claim 1 wherein the sheet of material wraps fully around the tree only one time.

4. The method of claim 1 wherein the sheet of material wraps around the tree less than 720°.

* * * * *